US011841009B2

(12) United States Patent
Albert

(10) Patent No.: US 11,841,009 B2
(45) Date of Patent: Dec. 12, 2023

(54) HYDROSTATIC MACHINE COMPRISING A CAM RING WITH ADJACENT BEARINGS OF SAME OUTER DIAMETER, AND MANUFACTURING METHOD

(71) Applicant: Laurent Eugene Albert, Frignicourt (FR)

(72) Inventor: Laurent Eugene Albert, Frignicourt (FR)

( * ) Notice: Subject to any disclaimer, the term of this patent is extended or adjusted under 35 U.S.C. 154(b) by 42 days.

(21) Appl. No.: 17/257,512

(22) PCT Filed: Jul. 3, 2019

(86) PCT No.: PCT/FR2019/051648
§ 371 (c)(1),
(2) Date: Feb. 28, 2021

(87) PCT Pub. No.: WO2020/008145
PCT Pub. Date: Jan. 9, 2020

(65) Prior Publication Data

US 2021/0285429 A1 Sep. 16, 2021

(30) Foreign Application Priority Data

Jul. 3, 2018 (FR) ..... 1856142

(51) Int. Cl.
*F04B 1/107* (2020.01)
*F04B 1/10* (2006.01)
*F01B 13/06* (2006.01)

(52) U.S. Cl.
CPC ..... *F04B 1/107* (2013.01); *F01B 13/06* (2013.01); *F01B 13/061* (2013.01); *F04B 1/10* (2013.01)

(58) Field of Classification Search
None
See application file for complete search history.

(56) References Cited

U.S. PATENT DOCUMENTS 2,111,658 A * 3/1938 Benedek ..... F01B 13/061 91/489
5,115,890 A 5/1992 Noel
(Continued)

FOREIGN PATENT DOCUMENTS

DE 551317 C 5/1932
DE 3219513 C2 * 11/1989 ..... F04B 1/1071
(Continued)

OTHER PUBLICATIONS

Foreign Patent Document DE-102015200310-A1 is attached in a single document with the NPL machine translation (Year: 2022).*
(Continued)

*Primary Examiner* — Bryan M Lettman
*Assistant Examiner* — Geoffrey S Lee
(74) *Attorney, Agent, or Firm* — TraskBritt

(57) ABSTRACT

A hydrostatic machine comprising a stator and a rotor. The stator comprises an inner cylindrical surface with a constant diameter and a cam ring comprising a cam track on the inner circumference thereof, the outer circumference of the cam ring being mounted in the aforementioned inner cylindrical surface. The hydrostatic machine also comprises two bearings that allow the rotation of the rotor in relation to the stator and that are mounted on the inner cylindrical surface of the stator, axially on either side of the cam ring, the cam ring and the two bearings having the same outer diameter.

10 Claims, 6 Drawing Sheets

(56) References Cited

U.S. PATENT DOCUMENTS

| | | | | |
|---|---|---|---|---|
| 5,391,059 | A * | 2/1995 | Hallund | F04B 1/0408 92/72 |
| 10,336,179 | B2 | 7/2019 | Albert | |
| 2013/0180237 | A1 | 7/2013 | Recoura et al. | |
| 2018/0306171 | A1* | 10/2018 | Matsuo | F04B 1/324 |

FOREIGN PATENT DOCUMENTS

| | | | | |
|---|---|---|---|---|
| DE | 3121531 | C2 * | 10/1991 | F04B 1/1071 |
| DE | 19544359 | A1 * | 7/1996 | F04B 1/07 |
| DE | 102005015905 | A1 | 10/2006 | |
| DE | 102005059031 | A1 | 6/2007 | |
| DE | 102009016010 | A1 | 10/2010 | |
| DE | 102015200310 | A1 * | 7/2016 | F01B 1/0603 |
| EP | 2617985 | A1 | 7/2013 | |
| FR | 2655090 | A1 | 5/1991 | |
| FR | 2901581 | A1 | 11/2007 | |
| FR | 3030381 | A1 | 6/2016 | |
| FR | 3049990 | A1 | 10/2017 | |
| GB | 663462 | A * | 6/1948 | F01B 13/061 |
| GB | 1440579 | A * | 6/1976 | F03C 1/0406 |
| GB | 2290835 | A | 1/1996 | |
| WO | WO-9210676 | A1 * | 6/1992 | F01B 13/061 |

OTHER PUBLICATIONS

Foreign Patent Document GB-1440579-A is attached in a single document with the NPL OCR text file (Year: 2022).*

Foreign Patent Document DE-3219513-C2 is attached in a single document with the NPL machine translation (Year: 2022).*

Foreign Patent Document DE-3121531-C2 is attached in a single document with the NPL machine translation (Year: 2022).*

Foreign Patent Document DE-19544359-A1 is attached in a single document with the NPL machine translation (Year: 2022).*

Foreign Patent Document GB-663462-A is attached is a document identified as NPL (Year: 2022).*

Oberg, E. Jones, F.D. Horton, H.L. Ryffell, H.H.. (2000). Machinery's Handbook (26th Edition)—Chromium Nickel Austenitic Steels. (pp. 403-443). Industrial Press. Retrieved from https://app.knovel.com/hotlink/pdf/id:kt002Q7J42/machinerys-handbook-26th/chromium-nickel-austenitic (Year: 2000).*

International Search Report for International Application No. PCT/FR2019/051648, dated Oct. 18, 2019, 6 pages (including English translation).

International Written Opinion for International Application No. PCT/FR2019/051648, dated Oct. 18, 2019, 13 pages (including English machine translation).

Anonymous, "Unalloyed and Alloyed Quenched and Tempered Steels—High Strength and Ductility After Hardening for Highly Stressed Components," 2023, 6 pages, thyssenkrupp Steel Europe, https://www.thyssenkrupp-steel.com/en/products/hot-strip/c-steel/unalloyed-and-alloyed-quenched-and-tempered-steel/unlegierter-und-legierter-verguetungsstahl.html (as accessed Apr. 12, 2023).

Anonymous, "Non-alloy Structural Steels," 6 pages, Salzgitter Flachstahl GmbH, https://www.salzgitter-flachstahl.de/en/products/hot-rolled-products/steel-grades/non-alloy-structural-steels.html (as accessed Apr. 12, 2023).

Madhusha, "Difference Between Alloy and Non Alloy Steel," Dec. 7, 2017, Pediaa.com, https://pediaa.com/difference-between-alloy-and-non-alloy-steel/ (as accessed Apr. 12, 2023).

Anonymous, "Interference Fit," last edited Feb. 23, 2023, Wikipedia, https://en.wikipedia.org/wiki/Interference_fit (as accessed Apr. 12, 2023).

* cited by examiner

HYDROSTATIC MACHINE COMPRISING A CAM RING WITH ADJACENT BEARINGS OF SAME OUTER DIAMETER, AND MANUFACTURING METHOD

CROSS-REFERENCE TO RELATED APPLICATIONS

This application is a national phase entry under 35 U.S.C. § 371 of International Patent Application PCT/FR2019/051648, filed Jul. 3, 2019, designating the United States of America and published as International Patent Publication WO 2020/008145 A1 on Jan. 9, 2020, which claims the benefit under Article 8 of the Patent Cooperation Treaty to French Patent Application Serial No. 1856142, filed Jul. 3, 2018.

TECHNICAL FIELD

The disclosure relates to the field of mechanics and of hydraulics and particularly relates to a hydrostatic machine.

BACKGROUND

Hydrostatic machines generally have one end connected to a structure and another end connected to a rotating drive element such as a wheel, a propeller or any transmission device.

Such a hydrostatic machine may be used as a hydraulic motor. It is then supplied with a pressurized hydraulic fluid and in response drives the rotating drive element.

The hydrostatic machine may also be employed as a hydraulic pump. It then receives a torque transmitted by the rotating drive element and in response compresses the hydraulic fluid.

Patent application FR3030381 describes a hydraulic motor comprising:

- a stator equipped with fixings for a structure and comprising a circumferential cam track;
- a rotor provided with fixings for a rotating drive element and comprising circumferentially distributed pistons suitable for interacting with the cam track; and
- a hydraulic distributor suitable for selectively supplying the pistons with hydraulic fluid so that the interaction of the pistons with the cam track corresponds to a relative rotation of the rotor with respect to the stator.

BRIEF SUMMARY

This disclosure describes improvements to the aforementioned type of machine from the point of view of compactness, robustness, and of the manufacturing process.

To this end, embodiments of the disclosure relate to a hydrostatic machine comprising:

- a stator equipped with fixings for a structure and comprising a circumferential cam track;
- a rotor provided with fixings for a rotating drive element and comprising circumferentially distributed pistons suitable for interacting with the cam track; and
- a hydraulic distributor suitable for selectively supplying the pistons with hydraulic fluid so that the interaction of the pistons with the cam track corresponds to a relative rotation of the rotor with respect to the stator.

The hydrostatic machine has the following features:

- the stator comprises an internal cylindrical surface (e.g., an inner cylindrical surface) of constant diameter and a cam ring that comprises, on its internal circumference, the cam track, and that is mounted, via its external circumference, in the internal cylindrical surface; and
- it comprises two bearings that allow the rotation of the rotor with respect to the stator, and that are mounted on the internal cylindrical surface of the stator, axially on either side of the cam ring, the cam ring and the two bearings having the same outside diameter.

Another subject to which embodiments of the disclosure relate is a process for manufacturing a hydrostatic machine, comprising the following acts:

- machining a tube of bearing steel to produce a cam ring having a cam track;
- mounting the cam ring and two bearings on a main body of a rotor, the cam ring being clamped between the two bearings, to form a sub-assembly; and
- axially inserting the sub-assembly into a stator that comprises an internal cylindrical surface of constant diameter, the bearings and the cam ring becoming mounted in the internal cylindrical surface.

Such a hydrostatic machine has an increased compactness, this being particularly advantageous when the hydrostatic machine is intended to be fitted in the wheel of a vehicle with a view to powering the latter. In the latter case, the more compact the hydrostatic machine, the better able it is to fit into the wheel rim of the vehicle.

On the internal cylindrical surface of the stator are mounted both the pivot elements linking with the rotor (the bearings) and the rotating drive elements of the rotor (the cam ring). No complex device or geometric arrangement is required to hold these elements axially, the cylindrical surface being of constant diameter.

Optionally, a shoulder may be provided on the stator at the end of this internal cylindrical surface and is enough to allow both the two bearings and the cam ring to be put in position in the stator.

Since the internal cylindrical surface is devoid of element(s) for positioning the bearings, the cam ring may then combine its function as a carrier of the cam track with a function as a positioning spacer between the two bearings, this contributing to the axial compactness of the machine. The axial compactness of the machine may be further improved by providing, on the cam ring, an annular abutment that enables placement against the external races of the bearings, as close to the bearing cages as possible, without however hampering the rotation of the latter.

According to one preferred feature, the stator comprises a tubular casing, this promoting radial compactness. The internal cylindrical surface of the rotor is then supported by a wall that is thin compared to the other dimensions of the machine.

Specifically, since the cam track is borne by a part (the cam ring) that is separate from the rest of the stator, the function of interacting with the pistons is decoupled from the function of structurally holding elements linked with the stator.

The cam track must have high hardness and high resistance to the wear caused by the pistons rolling over the cam track. These properties are generally provided by fragile materials, such as hardened steel. The cam ring is, therefore, advantageously made of such a material because its only dynamic function is to interact with the pistons.

The tubular casing, for its part, performs the function of structurally holding the elements that the stator contains and must, in contrast, have a certain ductility so as not to break or crack under the effect of shocks or any deformation during operation of the machine, which is supplied with a hydraulic fluid under high pressure. These properties are given to the stator via the choice of a ductile material, and of a thin thickness for the wall of the stator, which may thus bend. Bending is promoted, at least in the segment of the stator neighboring the internal cylindrical surface, by the fact that the stator does not require, in this segment, any functional areas of larger thickness or geometric shapes to position elements or to stiffen the stator.

In the prior art, the cam track is generally machined in the body of the stator and a surface-hardening heat treatment is provided in addition. Such a stator is difficult and expensive to produce.

According to one preferred feature of the disclosure, the cam ring may be made from a steel of the grade referred to as "bearing steel," or "carbon steel," which has a high proportion of carbon, a high resistance to wear and fatigue, but which is, however, sensitive to shocks. The weakness of the cam ring with respect to shocks is compensated for by the fact that it is mounted in the tubular casing of the rotor, which is ductile.

Embodiments of the disclosure thus allow advantage to be taken of the high performance of a material that is resistant to contact pressure and to fatigue to produce the cam track without suffering from the drawbacks normally associated with this type of material.

This assembly moreover allows the process for manufacturing the hydrostatic machine to be considerably simplified.

Specifically, during the assembly of such a machine, a main body of the rotor may be equipped beforehand with the two bearings and the cam ring, the two bearings framing on either side the cam ring while holding it axially. This sub-assembly consisting of the main body of the rotor, of the bearings, and of the cam ring may then be, in a single operation, mounted inside the stator so that the two bearings and the cam ring are slid along the internal cylindrical surface. The assembly operations are, therefore, considerably simplified.

The number of operations required to produce the stator is also decreased because of the presence of the tubular stator casing, which may be produced from a steel tube requiring few or no machining operations. The cam ring may be produced by machining a tube of bearing steel, which is inexpensive because it is produced in large volumes for the manufacture of bearings, and which has excellent properties in respect of hardness and resistance to contact fatigue.

The production of such a hydrostatic machine is, therefore, faster and less expensive.

The hydrostatic machine may in addition comprise the following additional features, alone or in combination:

- the hydrostatic machine comprises a tubular casing, the internal cylindrical surface being defined by the tubular casing;
- the cam ring has a ductility lower than that of the tubular casing;
- the cam ring is made of bearing steel and the tubular casing is made of non-alloy steel or austenitic stainless steel;
- the material of the cam ring and that of the two bearings is the same bearing steel;
- the cam ring is fitted tightly in the tubular casing;
- the machine comprises anti-rotation fixings for coupling the cam ring and the stator;
- the machine comprises: a clamping ring placed axially against one of the bearings and against the rotor; and a lip seal placed between the clamping ring and the stator;
- the clamping ring is fastened to the rotor by a hub screwed into the rotor and bearing the fixings (e.g., fasteners) for a rotating drive element; and/or
- the fixings (e.g., fasteners) for a rotating drive element consist of screws the heads of which are clamped by the hub.

BRIEF DESCRIPTION OF THE DRAWINGS

A preferred example of an embodiment of the disclosure will now be described with reference to the accompanying drawings, in which.

DETAILED DESCRIPTION

Figure 1:
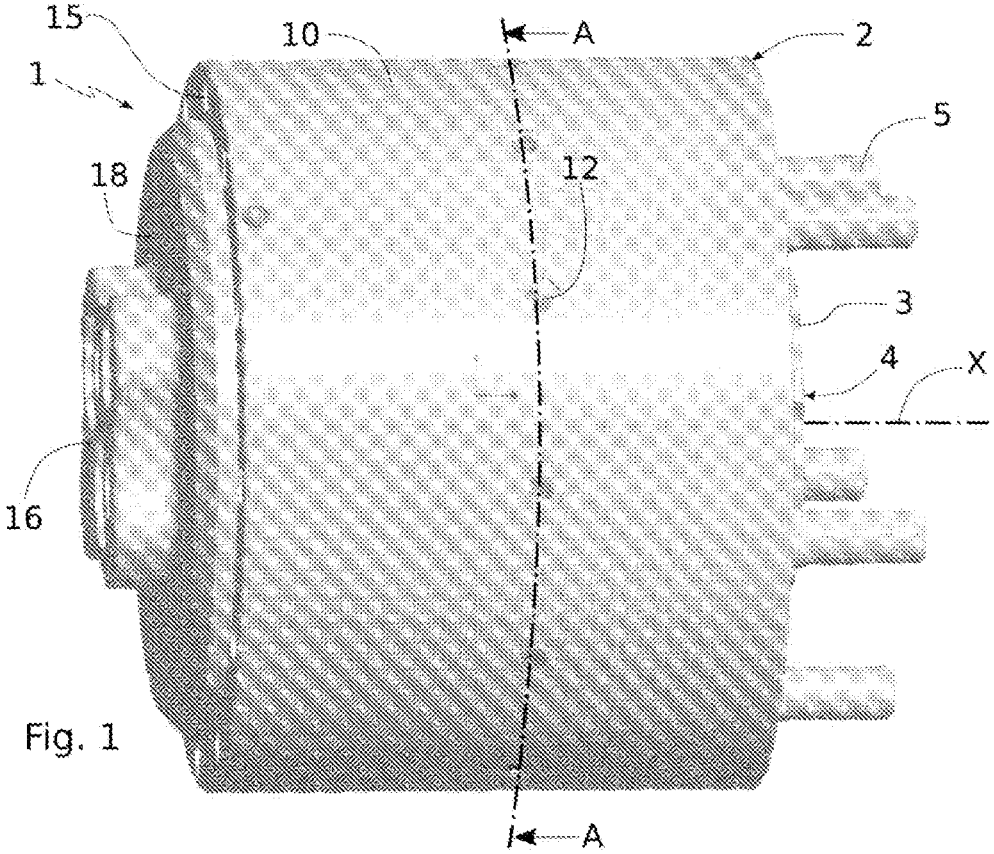
FIG. 1 shows a hydrostatic machine according to the disclosure, seen from the side.
Figure 2:
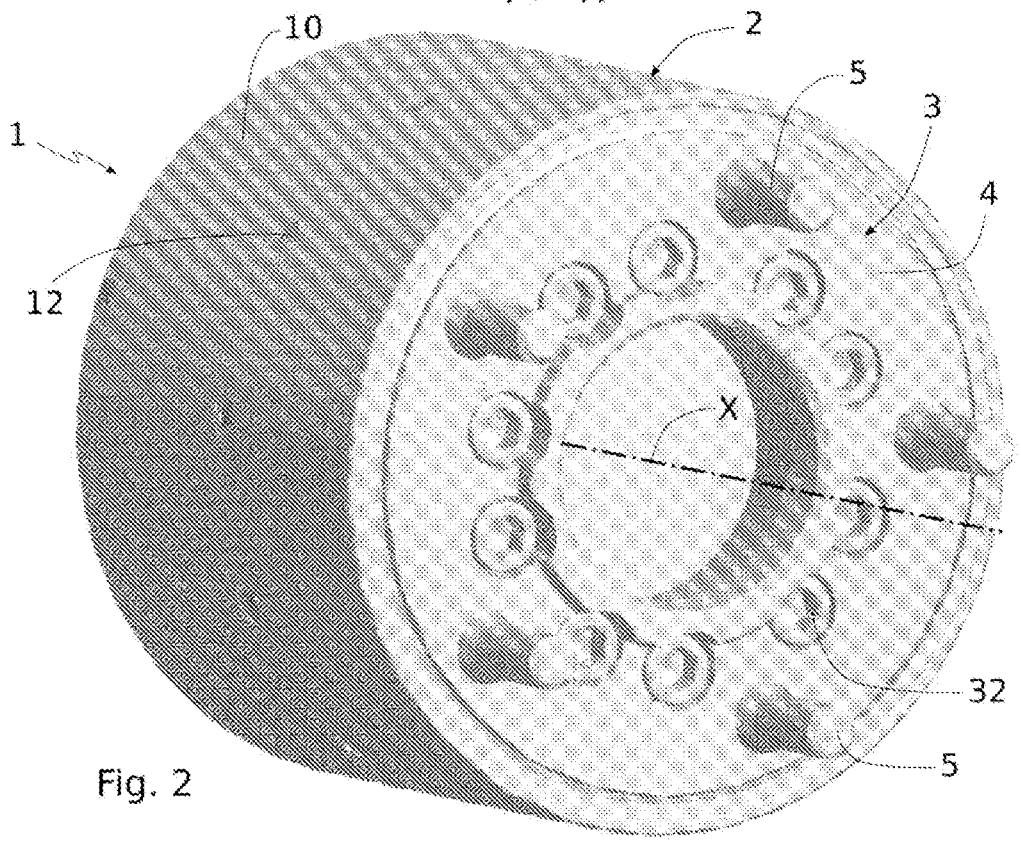
FIG. 2 is a perspective view showing the machine of FIG. 1, from the rotor side.

FIGS. 1 and 2 show a hydrostatic machine 1 according to embodiments of the disclosure, seen in profile and in perspective from the rotor side, respectively.

The hydrostatic machine 1 has a generally cylindrical shape and comprises a stator 2 and a rotor 3. A relative rotational movement is allowed between the stator 2 and the rotor 3, around an axis X. The generally cylindrical shape is adapted to the internal make-up of the machine and allows it to be mounted, at least partially, in a cylindrical element relatively to the rotating drive element, in the rim of a wheel for example.

In the present example, the hydrostatic machine 1 is intended to be fastened to a structure consisting of the chassis of a vehicle (not shown). A wheel (not shown) is mounted on the rotor of the machine so that the vehicle may be propelled by the rotation of the wheel.

The hydrostatic machine 1 comprises, on the structure side (on the left in FIG. 1) means (e.g., threaded bores 15) for fastening to the structure and means (e.g., hydraulic connectors 16) for supplying hydraulic fluid with a view to supplying power to the hydrostatic machine 1.

On the wheel side (on the right side in FIG. 1), the hydrostatic machine 1 comprises a wheel hub 4 that forms part of the rotor 3. This wheel hub 4 comprises (e.g., bears) fastening means (e.g., fasteners) for a rotating drive element. In the present example, the rotating drive element is a vehicle wheel (not shown) and the fastening means are studs 5 for fastening the vehicle wheel. Accordingly, the hydrostatic machine 1 may include a hub (e.g., wheel hub 4) bearing (e.g., supporting) fasteners (e.g., studs 5) for a rotating drive element.

The hydrostatic machine 1, being thus fastened to a structure by its stator 2, and being attached to a vehicle wheel by its rotor 3, may operate in two modes:

a motor mode in which the energy of the pressurized fluid is converted into mechanical energy and causes the rotation of the wheel and, therefore, the movement of the vehicle; and a generator mode in which the wheel is driven to rotate by the environment (for example, when the vehicle is on a downward slope) and itself drives the rotor 3 to rotate to place the hydraulic fluid under pressure.

FIG. 2 shows the fastening holes of the wheel hub 4 on the rest of the rotor 3.

Figure 3:
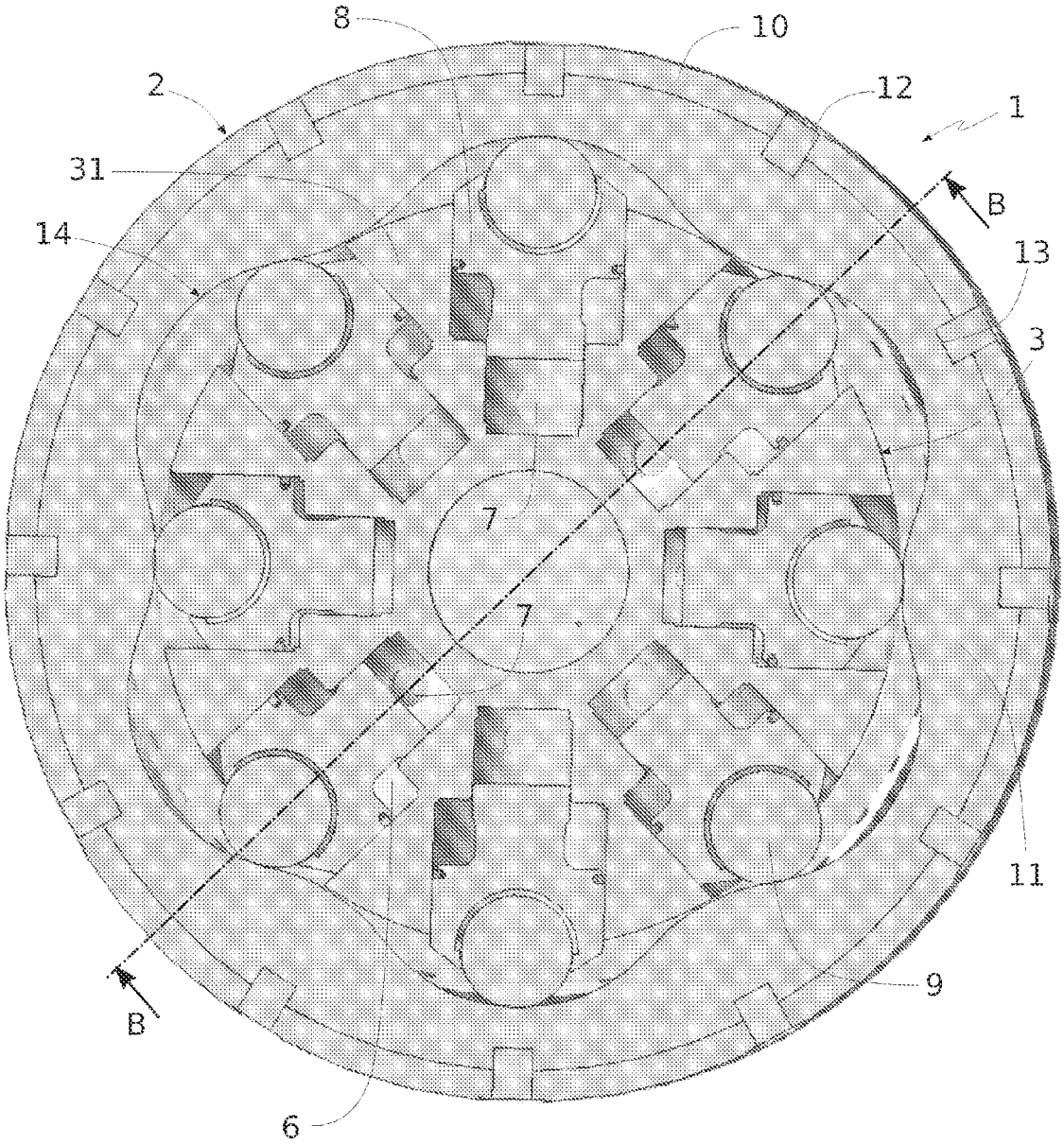
FIG. 3 is a face-on cross-sectional view of section AA of FIG. 1.

FIG. 3 is a cross-sectional view of section A-A of FIG. 1 and illustrates the operating principle of the hydrostatic machine 1.

The portion of the rotor 3 that may be seen in FIG. 3 is its main body 31. It is a circular part in which are drilled eight radial cylinders 6, which are distributed circumferentially around the main body 31 of the rotor 3.

An orifice 7 for supplying hydraulic fluid opens into each of these cylinders 6.

A piston 8 is inserted into each cylinder 6 so that pressurization of the hydraulic fluid via the supply orifice 7 causes the piston 8 to exit radially outwards and, conversely, the movement of the piston 8 when it is forced radially inwards causes hydraulic fluid to exit via the supply orifice 7 (to simplify the figure, only three pistons 8 have been shown in FIG. 3).

Each piston 8 is equipped with a roller 9 that is movably mounted on the piston 8 with respect to an axis parallel to the axis X.

Moreover, two elements of the stator 2 have been shown in FIG. 3: a tubular casing 10 and a cam ring 11.

The cam ring 11 is mounted in the tubular casing 10 and these elements are secured together. Anti-rotation fixings allow the cam ring 11 and the tubular casing to be secured together so as to rotate as one. In the present example, the anti-rotation fixings comprise holes 12 distributed around the circumference of the tubular casing 10, and corresponding holes 13 in the cam ring 11, as well as screws (not shown) to ensure the fastening. The cam ring 11 comprises on its internal circumference a cam track 14 to which a succession of recesses and bumps give a wavy shape. During the operation of the hydrostatic machine 1, the rollers 9 of the pistons 8 roll over the cam track 14.

The cam ring 11 is made of bearing steel, 100Cr6 steel for example. The cam ring 11 is advantageously fitted tightly in the tubular casing 10. The tubular casing 10 is made of a more ductile material than the cam ring 11. Clamping the cam ring 11 in the tubular casing 10 allows the cam ring 11 to be kept in compression in the tubular casing 10, this contributing to preventing the appearance of fatigue cracks in the cam ring 11.

In a known way, the pistons 8 are selectively supplied with pressurized fluid depending on their angular position with respect to the cam track 14 so that the pressure of the fluid is converted into rotation of the cam track 14 and, therefore, of the rotor 3.

Figure 4:
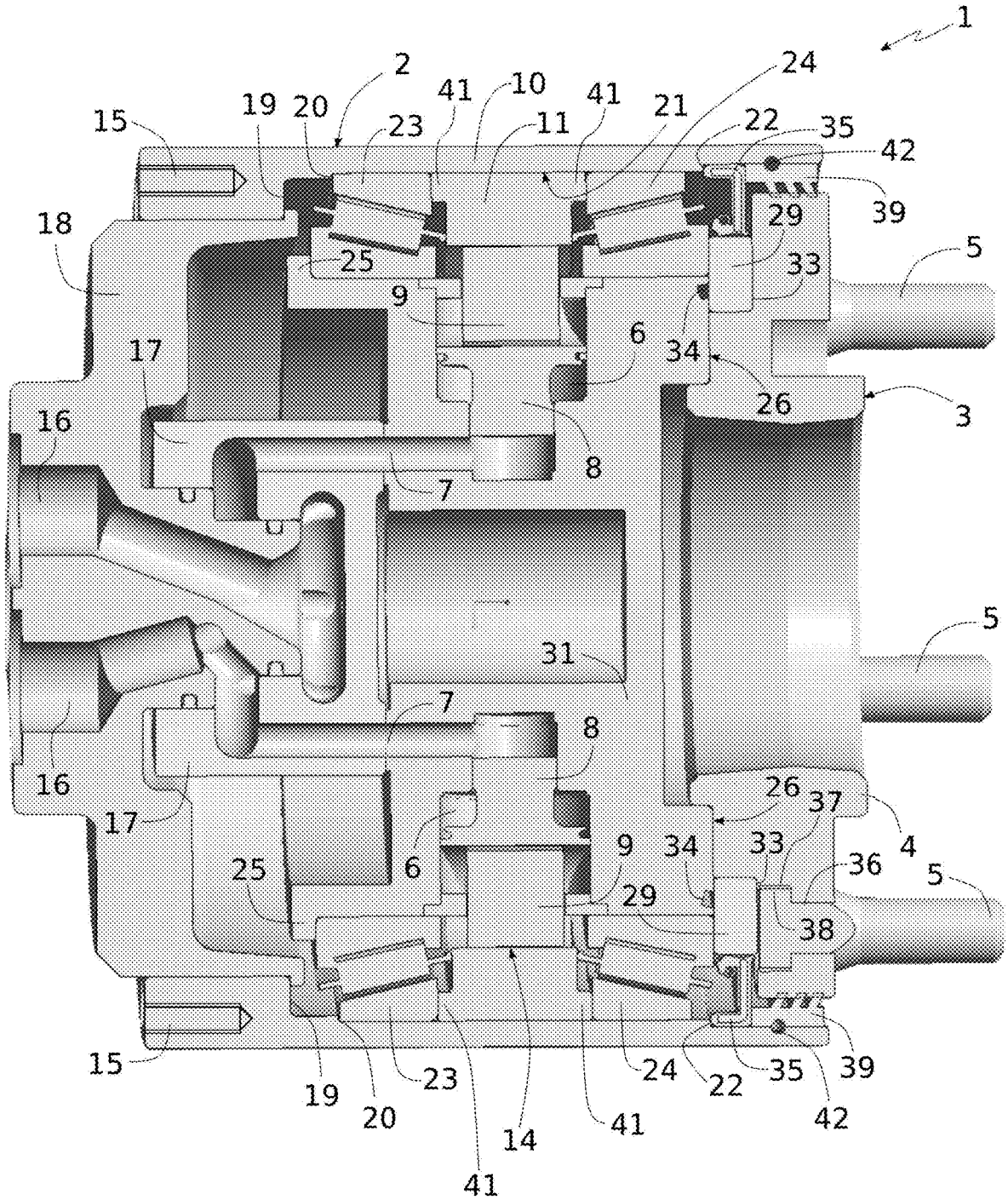
FIG. 4 is a side cross-sectional view of section BB of FIG. 3.

FIG. 4 is a cross-sectional view of section B-B of the hydrostatic machine 1 of FIG. 3.

The stator 2 is formed from two portions: a base 18 and a tubular casing 10. FIG. 4 shows, from the structure side, the means for fastening the hydrostatic machine 1 to the structure of the vehicle. In the present example, these are threaded bores 15 that are regularly distributed around the circumference of the tubular casing 10 and that allow it to be fastened by screws to the structure (not shown).

The stator 2 also comprises, on the structure side, hydraulic connectors 16 that are intended to connect the ducts of the hydraulic circuit of the vehicle with a view to supplying hydraulic fluid to the hydrostatic machine 1.

These hydraulic connectors 16 are arranged on the base 18 and are connected, by internal channels of the stator 2, to a hydraulic distributor 17. The hydraulic distributor 17 is itself equipped with internal ducts that allow hydraulic fluid to be selectively supplied to the pistons 8.

The operation of the hydraulic distributor 17, and more generally of the selective supply of the pistons 8 with hydraulic fluid, takes place in accordance with what is known in this field. This operation, which will, therefore, not be described in more detail here, allows pressurized hydraulic fluid to be delivered to certain pistons 8, via their supply orifice 7, and allows the hydraulic fluid to exit from certain other pistons 8, via their supply orifice 7.

The tubular casing 10 is a tube fitted onto the base 18. In the present example, it is a question of a press fit that allows the base 18 to be securely fastened to the tubular casing 10 without any other additional fasteners. As a variant, screws or any other fastening means may be provided to consolidate the assembly.

Where it is press fitted, the tubular casing 10 comprises a reinforcing shoulder 19. The threaded bores 15 for fastening the hydrostatic machine 1 to the structure are here produced in this reinforcing shoulder 19.

From the reinforcing shoulder 19, the tubular casing 10 extends, in the direction of the wheel side, such as to form a first shoulder 20, an internal cylindrical surface 21 (also referred to herein as an "inner" cylindrical surface) of constant diameter, and a second shoulder 22, these elements being arranged in tiers, i.e., the inside diameters defined by the first shoulder 20, the internal cylindrical surface 21, and the second shoulder 22, respectively, increase in the direction of the wheel side.

Apart from the reinforcing shoulder 19, the function of which is not related to interaction with the rotor 3 but only to fastening and assembly of the stator 2, the tubular casing 10, therefore, has three inside diameters the largest of which is located on the wheel side.

On the internal cylindrical surface 21 are mounted:

a first bearing 23, the external race of which is placed axially against the first shoulder 20;

the cam ring 11, which is axially positioned by its fixings (e.g., corresponding holes 13); and a second bearing 24, the external race of which is axially placed against a clamping ring 29.

The cam ring 11 comprises an annular abutment 41 for mounting it in the tubular casing 10. The abutment 41 is clamped between the external races of the two bearings 23, 24.

The bearings are here made of bearing steel, 100Cr6 steel for example. The external races of the bearings 23, 24 and the cam ring 11 are, therefore, made of the same, preferably through-hardened, material (100Cr6 steel).

As regards the rotor 3, the cross section of FIG. 4 allows the profile of two cylinders 6 and of their respective supply orifice 7 to be seen.

The rotor 3 is mounted so as to be able to rotate inside the tubular casing 10 by virtue of the bearings 23, 24, which interact with the main body 31 of the rotor 3. The internal race of the first bearing 23 is mounted on the rotor 3 so that it abuts axially against a shoulder 25 of the rotor 3, this shoulder 25 being located on the structure side.

The second bearing 24 is mounted on the rotor 3, on the wheel side, so that the two bearings 23, 24 lie on either side of each cylinder 6.

The end of the main body 31, which is on the wheel side, has a radial face 26 that coincides with the rim of the internal race of the second bearing 24. The dimensions of the main body 31, of the bearings 23, 24, and of the cam ring 11, are chosen so that the succession of dimensions between the shoulder 25 and the rim of the internal race of the second bearing 24 leads to an alignment, in the same plane, of the radial face 26 and of the rim of the internal race of the second bearing 24. Thus, an axial end of the internal race of the second bearing 24 lies in the same plane as the radial face 26 of the main body 31.

The rotor 3 in addition comprises a clamping ring 29 that abuts axially both against the internal race of the second bearing 24 and against the radial face 26.

As a variant, the aforementioned succession of dimensions causes the rim of the internal race of the second bearing 24 to be axially slightly beyond the radial face 26, so that fastening the clamping ring 29 pre-stresses the bearings 23, 24.

The rotor 3 also comprises the wheel hub 4, which is fastened against the radial face 26 of the main body 31 by the screws 32. The wheel hub 4 has a shoulder 33, the axial dimension of which is equal to the axial dimension of the clamping ring 29.

Thus, when the wheel hub 4 is screwed against the main body 31, the clamping ring 29 is pressed both against the main body 31 and against the internal race of the second bearing 24, and held in this position. Accordingly, the clamping ring 29 may be fastened to the rotor 3 by a hub (e.g., wheel hub 4) screwed into the rotor 3. The hub (e.g., wheel hub 4) may bear (e.g., support) fasteners (e.g., studs 5) for a rotating drive element (e.g., a wheel), as described further below.

The rotor in addition comprises an O-ring 34 placed in a groove of the main body 31 and interposed between the latter and the clamping ring 29, in order to ensure seal tightness between these two elements.

Furthermore, a lip seal 35 is interposed between the clamping ring 29 and the tubular casing 10. The lip seal 35 is placed in axial abutment against the second shoulder 22.

The O-ring 34 and the lip seal 35 together form an outwardly seal-tight barrier that confines, within the tubular casing 10, any hydraulic fluid that may be found therein.

As a variant, while remaining clear of the bearing cage of the second bearing 24, the lip seal 35 may be placed directly in abutment with the second bearing 24.

The wheel hub 4 comprises, as also shown in FIG. 4, threaded holes 36 for mounting the studs 5. Accordingly, a hub (e.g., wheel hub 4) may bear (e.g., support) fasteners (e.g., studs 5) for a rotating drive element (e.g., wheel). In the present example, the studs 5 consist of screws having a head 38 that is, for example, a hexagonal socket head. Each threaded hole 36 is associated with a counterbore 37, the axial dimension of which is equal to the height of the corresponding head 38.

The head 38 of the screws forming the studs 5 is, therefore, blocked in both axial directions: by the counterbore 37 on the right side (with reference to FIG. 4) and by the clamping ring 29 on the left side (the right and left sides are indicated with reference to FIG. 4). Accordingly, the fasteners (e.g., studs 5) for the rotating drive element (e.g., wheel) may comprise screws with heads (e.g., heads 38) clamped by the hub e.g., wheel hub 4). The height of the head 38 and the axial dimension of the counterbore 37 are, therefore, chosen so that the studs 5 are unable to become loose in normal operation.

A dust-proof ring seal 39 may in addition be provided between the wheel hub 4 and the tubular casing 10. The dust-proof ring seal 39 comprises a groove 42 equipped with an axial stop. Thus, if the pressure in the casing were to push the lip seal 35 outwards, contact with the dust-proof ring seal 39 and this axial stop will prevent any dislodgement of the seals 35, 39.

The threaded bores 15 that allow the hydrostatic machine 1 to be fastened to a chassis are produced in the tubular casing 10 so that the forces are transmitted via a short mechanical path between the rotor and the chassis, this path passing only through the bearings 23, 24 and the tubular casing 10.

Figure 5:
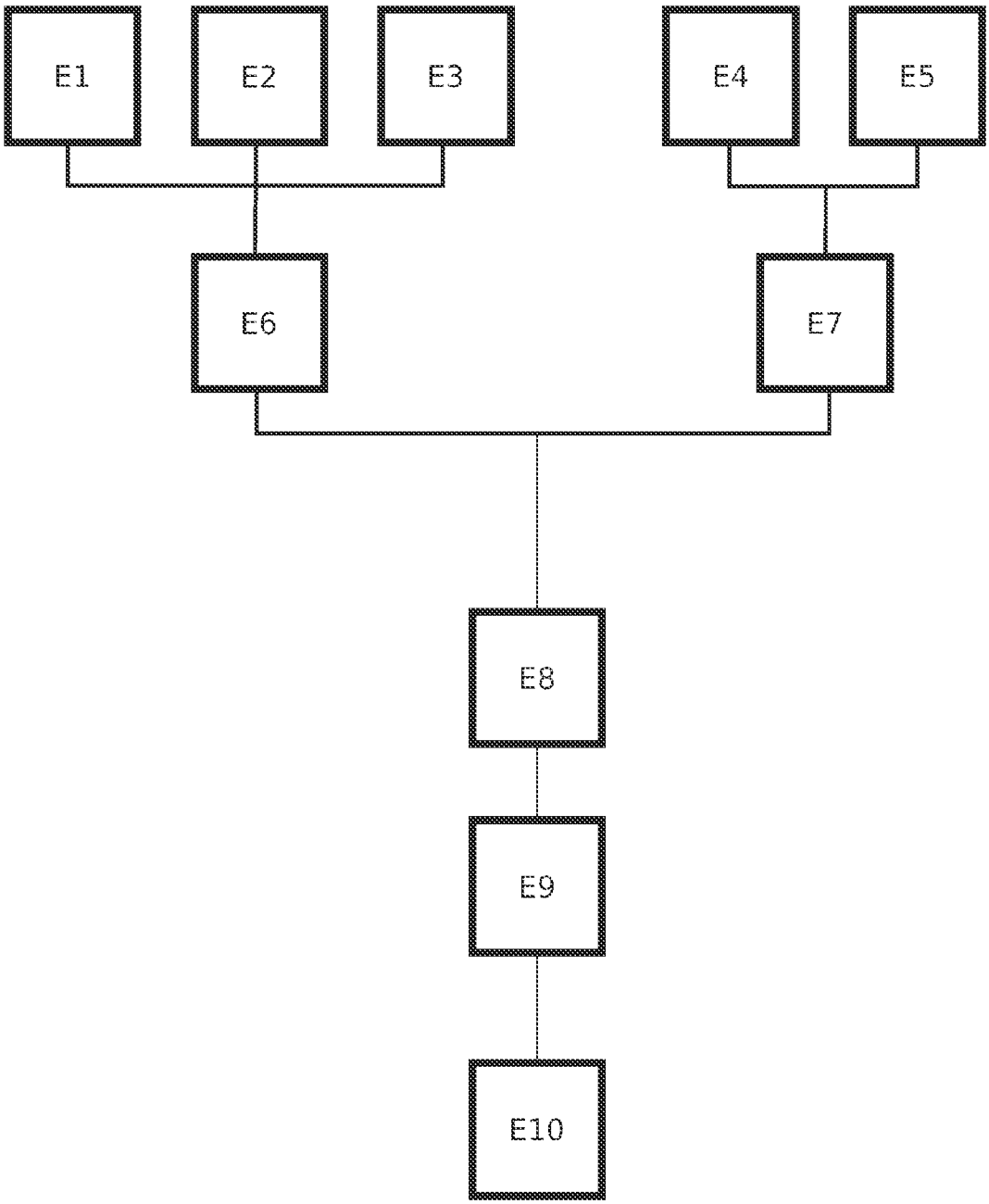
FIG. 5 is a schematic illustrating a process for manufacturing the machine of FIGS. 1 to 4.

The process of manufacturing the hydrostatic machine 1 will now be described with reference to FIG. 5, which schematically shows the main steps of the manufacturing process.

The base 18, the tubular casing 10 and the hydraulic distributor 17 are produced in steps E1, E2 and E3, respectively. The base 18 and the hydraulic distributor 17 are produced by any conventional mechanical means of manufacture, by molding and machining of the functional parts for example. The tubular casing 10 is advantageously produced from a tube of rolled steel of E470 grade (according to European steel grade designation system E10027), which has the advantage of being inexpensive and of having a ductility sufficient for the job of the tubular casing 10. The tubular casing 10 is thus advantageously made of a weldable steel in order, optionally, to be able to weld therein any external fixings required to mount the hydrostatic machine 1.

Figure 7:
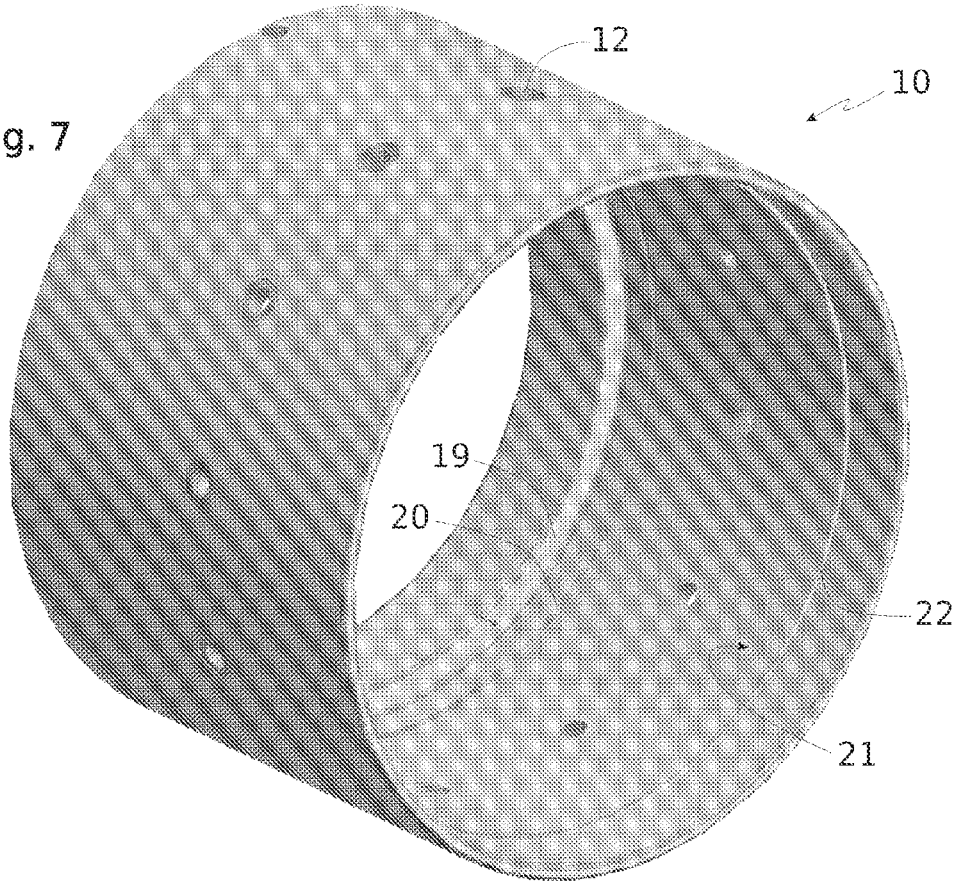
FIG. 7 shows in perspective the tubular casing of the machine of FIG. 1.

The thickness of this tube of E470 steel is equal to the intended thickness of the reinforcing shoulder 19, the internal surface of this tube then being machined to form the first shoulder 20, the internal cylindrical surface 21 and the second shoulder 22. The holes 12 for fastening the cam ring 11 are lastly drilled in the tubular casing 10. The tubular casing 10 produced in step E2 is shown in FIG. 7.

In step E6, the base 18 and the tubular casing 10 are assembled by press fitting, then the hydraulic distributor 17 is placed on the base 18.

In parallel with the steps described above, the main body 31 and the cam ring 11 are manufactured in steps E4 and E5, respectively. The main body 31 is also produced by any conventional mechanical means. The cam ring 11 is advantageously produced from a tube of bearing steel, 100Cr6 steel for example (according to European steel grade designation system E10027), the outside diameter of which is substantially equal to the diameter of the internal cylindrical surface 21 of the tubular casing 10, depending on how tightly it is desired for the cam ring 11 to fit in the tubular casing 10. To produce the cam ring 11, a slice of such a tube of bearing steel, of a dimension equal to the intended axial dimension of the base (e.g., abutment 41) of the cam ring 11, is first cut. An annulus is thus obtained, and the internal surface of this annulus is then machined with a digital milling machine to obtain the cam path (e.g., cam track 14) shown in FIG. 3.

Lateral recesses are then machined in the cam ring 11 to form the abutment 41 of the cam ring 11. The abutment 41 is intended to be clamped between the external races of the two bearings 23, 24, and the lateral recesses allow the passage of the bearing cages, which project axially with respect to the internal race. Since the abutment 41 makes contact with the external races of the bearings 23, 24, the two side faces of the abutment 41 need to have a good planarity. The abutment 41 is, therefore, ground after the lateral recesses have been machined (which also allows less material to be ground).

Figure 8:
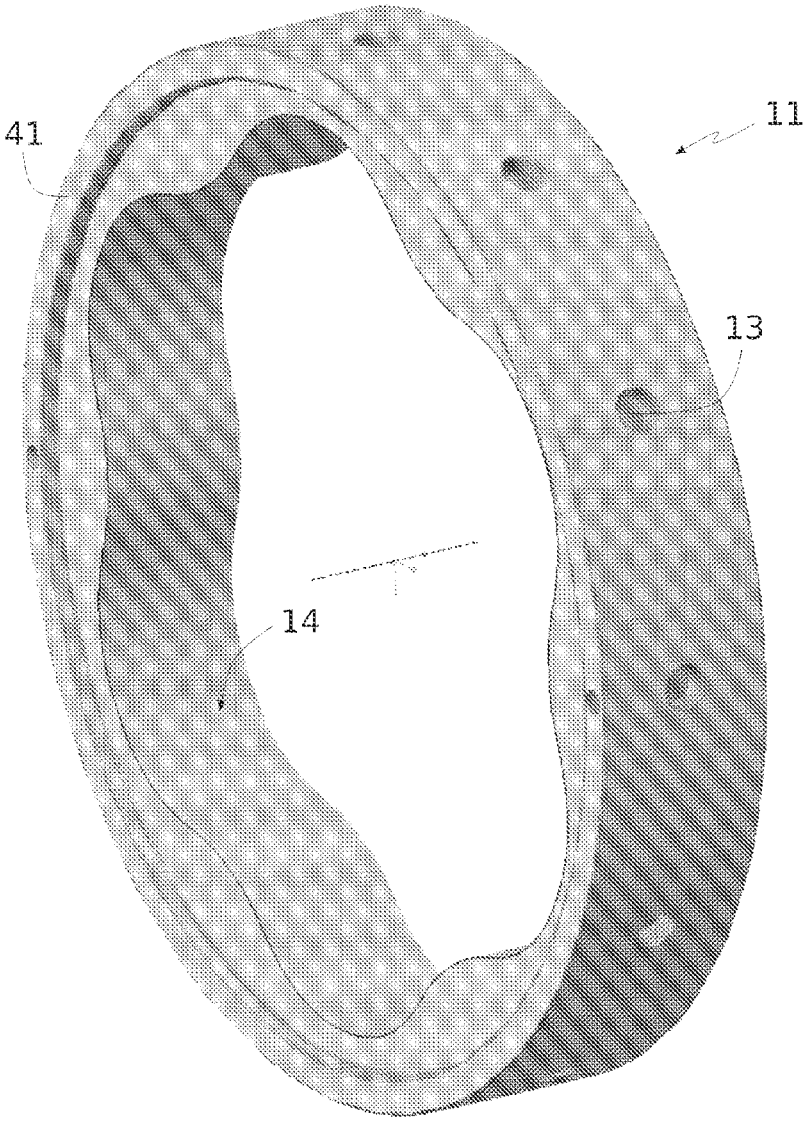
FIG. 8 shows in perspective the cam ring of the machine of FIG. 1.

The corresponding holes 13 intended for fastening are then produced in the tubular casing around the entire perimeter of the cam ring 11. The cam ring 11 that results from operation E5 is shown in FIG. 8.

Figure 6:
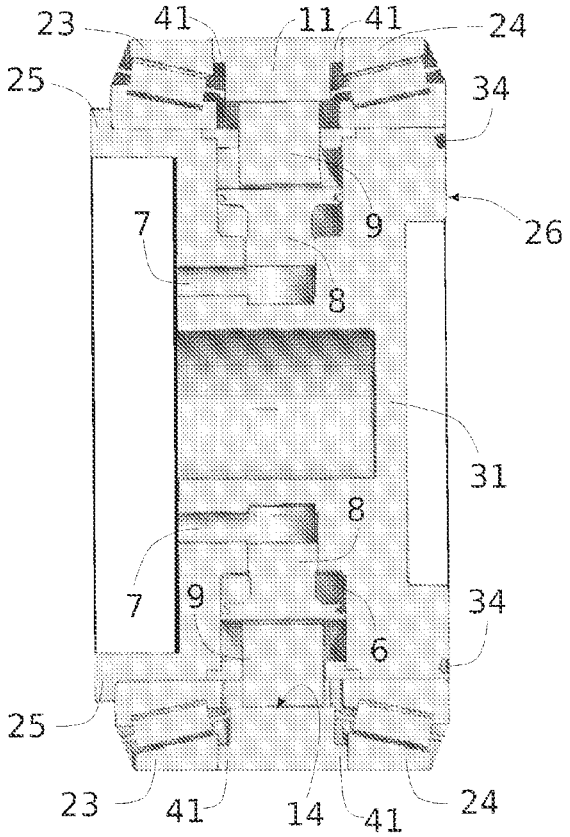
FIG. 6 shows, in cross section, a sub-assembly intended for producing the machine of FIGS. 1 to 4.

In a step E7, the main body 31, the cam ring 11, and the two bearings 23, 24 are assembled to obtain the sub-assembly shown in FIG. 6. The first bearing 23 is firstly mounted around the main body 31 until it abuts against the shoulder 25. The internal race of the first bearing 23 (and also the internal race of the second bearing 24) may be assembled so as to slightly clamp the main body 31.

The cam ring 11 is then mounted around the main body 31 so as to abut against the first bearing 23. More precisely, the abutment 41 makes contact with the external race of the first bearing 23. The cam ring 11 has, in this position, no radial support for its internal surface (the cam track 14) and must, therefore, be positioned so that its external surface is aligned with the external surface of the first bearing 23.

The second bearing 24 is then in turn mounted around the main body 31 until its external race abuts against the base (e.g., the abutment 41) of the cam ring 11.

As described above, the dimensions of these various elements are chosen so that, once mounting of the sub-assembly has ended, the rim of the internal race of the second bearing 24 coincides with the radial face 26. The cam ring 11 is moreover positioned axially by the bearings 23, 24.

In a step E8, the sub-assembly of FIG. 6 is inserted in a single operation into the tubular casing 10 (FIG. 7) until the external race of the first bearing 23 abuts against the first shoulder 20 of the tubular casing 10. The cam ring 11 is advantageously fitted tightly in the tubular casing 10, with an allowance for example of 0.01 mm to 0.05 mm. The bearings 23, 24 may also be mounted in the tubular casing 10 so as to fit tightly.

The sub-assembly of FIG. 6 may be mounted in the tubular casing 10 (FIG. 7), for example with a ram, all thereof being pushed with a tubular mounting tool the outside diameter of which is slightly smaller than the diameter of the internal cylindrical surface 21 and the thickness of which is small enough that it interacts only with the external race of the second bearing 24. This mounting operation is, therefore, a single simple mechanical operation.

The cam ring 11, the corresponding holes 13 of which must be angularly positioned so that each is placed in front of a hole 12 of the tubular casing 10, must however be indexed angularly.

In a step E9, the clamping ring 29 and the lip seal 35 are conjointly placed in the tubular casing 10, until the lip seal 35 abuts axially against the second shoulder 22 of the tubular casing 10. The clamping ring 29 is then positioned by the lip seal 35.

In a step E10, the wheel hub 4, provided with the studs 5 already in place, is screwed against the main body 31, thus clamping the clamping ring 29, and the dust-proof ring seal 39 is fitted last.

The cam ring 11 is, in the present example, made of 100Cr6 steel, as are the two bearings 23, 24.

Two races and one ring of the same material (the external race of the first bearing 23, the cam ring 11, and the external race of the second bearing 24) are, therefore, mounted on the internal cylindrical surface 21 of the tubular casing 10.

The tubular casing 10, because of its tubular shape and of the material from which it is made, has the mechanical behavior of a tube, in particular as regards the bending of its walls. In other words, the tubular casing 10 may bulge out if it is locally deformed outwardly by the cam ring 11, or, in contrast, it may become concave if the cam ring 11 is mechanically deformed inwardly.

During its operation, the hydrostatic machine 1 has an increased longevity because of the damping, by the tubular casing 10, of the deformations and shocks exerted on the cam ring 11.

The increased longevity is also due to the presence of a high amount of carbon in the bearing steel used for the cam ring 11, this contributing to the very low oxygen content of this steel.

Moreover, as regards the maintenance of the hydrostatic machine 1, the wheel hub 4 can be removed, for example to change or repair the studs 5. Such an operation is here carried out simply by unscrewing the screws 32 and by extracting the wheel hub 4 without the interior of the hydrostatic machine 1 being opened, i.e., without any seal needing to be removed.

The interior of the hydrostatic machine 1 thus remains seal tight, making the operation of removing and installing the wheel hub 4 simple and clean and of low criticality.

Other variant embodiments of the hydrostatic machine 1 may be implemented without departing from the scope of the disclosure. For example, the materials employed for the cam ring 11 and the tubular casing 10 may be other materials than those mentioned in the described example, provided that the material of the tubular casing 10 has a higher ductility than the cam ring 11.

In addition, the hydrostatic machine 1 may be fastened to a structure other than that of a vehicle, to a stationary machine for example, and the rotating drive element may be an element other than a wheel, for example a gearbox, a machine component or any other transmission device or component to be powered.

Alternatively to E470 steel, which was given above by way of an example of a ductile material from which the tubular casing 10 could be made, the tubular casing 10 may also be made from a tube of stainless steel that will advantageously be non-martensitic in order to have a sufficient ductility for the job of the tubular casing 10, and in any event a higher ductility than the cam ring 11. Preferably, the stainless steel will be austenitic, and for example an iron-chromium-nickel alloy with less than 0.1% carbon, such as "18/10" stainless steel. In this case, the wheel hub 4 may in addition also be made of stainless steel, this allowing the hydrostatic machine 1 to have an exterior entirely of stainless steel allowing the hydrostatic machine 1 to be used in corrosive environments such as sea water or corrosive chemicals. In the same spirit, the tubular casing 10 and the wheel hub 4 may both be made of another material suitable for a particular application.

The invention claimed is:

1. A hydrostatic machine, comprising:

a stator comprising attachments for a structure and comprising a circumferential cam track;

a rotor comprising attachments for a rotating drive element and comprising pistons distributed circumferentially and adapted to cooperate with the cam track; and a hydraulic distributor adapted to selectively supply the pistons with hydraulic fluid so that the cooperation of the pistons with the cam track corresponds to a relative rotation of the rotor with respect to the stator, wherein the stator has an inner cylindrical surface of constant diameter and a cam ring comprising, on its inner circumference, the cam track, and that is mounted, by its outer circumference, in the inner cylindrical surface, wherein two bearings allow rotation of the rotor relative to the stator and are mounted on the inner cylindrical surface of the stator, axially on both sides of the cam ring, the cam ring and the two bearings having the same outer diameter, and wherein the hydrostatic machine further comprises:

a clamping ring arranged axially against one of the two bearings and against the rotor; and a lip seal between the clamping ring and the stator, wherein the clamping ring is fastened to the rotor by a hub screwed into the rotor, the hub bearing fasteners for the rotating drive element.

2. The hydrostatic machine of claim 1, wherein the stator further comprises a tubular casing defining the inner cylindrical surface of the stator.

3. The hydrostatic machine of claim 2, wherein the cam ring exhibits less ductility than the tubular casing.

4. The hydrostatic machine of claim 3, wherein:

the cam ring comprises bearing steel; and the tubular casing comprises non-alloyed steel.

5. The hydrostatic machine of claim 3, wherein:

the cam ring comprises bearing steel; and the tubular casing comprises austenitic stainless steel.

6. The hydrostatic machine of claim 3, wherein the cam ring and the two bearings comprise a same bearing steel.

7. The hydrostatic machine of claim 2, wherein the cam ring is fitted tightly in the tubular casing.

8. The hydrostatic machine of claim 1, further comprising anti-rotation fasteners for coupling the cam ring and the stator.

9. The hydrostatic machine of claim 1, wherein the fasteners borne by the hub for the rotating drive element comprise screws with heads clamped by the hub.

10. A method for manufacturing a hydrostatic machine, the method comprising:

machining a tube of bearing steel to produce a cam ring comprising a cam track;

mounting the cam ring and two bearings on a main body of a rotor, the cam ring being clamped between the two bearings to form a sub-assembly;

axially inserting the sub-assembly into a stator comprising an inner cylindrical surface of constant diameter, the two bearings and the cam ring being thereby mounted in the inner cylindrical surface; and placing a clamping ring and a lip seal in the tube of bearing steel with the clamping ring arranged axially against one of the two bearings and against the rotor and with the lip seal between the clamping ring and the stator, the clamping ring being fastened to the rotor by a hub screwed into the rotor, the hub bearing fasteners for the rotating drive element.

* * * * *